US005915447A

United States Patent [19]

Lassen

[11] Patent Number: 5,915,447

[45] Date of Patent: Jun. 29, 1999

[54] OPERATING ARRANGEMENT FOR AN ELECTRICALLY OPERATED WINDOW SCREENING DEVICE

[75] Inventor: Gert Godvig Lassen, Skjern, Denmark

[73] Assignee: V. Kann Rasmussen Industri A/S, Soborg, Denmark

[21] Appl. No.: 08/860,423

[22] PCT Filed: Jan. 17, 1996

[86] PCT No.: PCT/DK96/00027

§ 371 Date: Jun. 24, 1997

§ 102(e) Date: Jun. 24, 1997

[87] PCT Pub. No.: WO96/22447

PCT Pub. Date: Jul. 25, 1996

[30] Foreign Application Priority Data

Jan. 18, 1995 [DK] Denmark ..... 0054/95

[51] Int. Cl.[6] ..... A47G 5/02

[52] U.S. Cl. ..... 160/265; 160/319; 160/370.22

[58] Field of Search ..... 160/370.22, 265, 160/280, 319, 310

[56] References Cited

U.S. PATENT DOCUMENTS

| | | | |
|---|---|---|---|
| 550,668 | 10/1895 | Li . | |
| 4,494,707 | 1/1985 | Niibori et al. | 160/265 X |
| 4,848,224 | 7/1989 | Woodworth | 160/265 X |
| 5,025,847 | 6/1991 | Mueller | 160/265 X |
| 5,404,926 | 4/1995 | Ojima et al. | 160/310 X |
| 5,515,898 | 5/1996 | Alcocer | 160/265 X |
| 5,620,039 | 4/1997 | Delgado et al. | 160/265 |

FOREIGN PATENT DOCUMENTS

| | | | |
|---|---|---|---|
| 318989 | 12/1969 | Sweden | 160/171 |
| 12632 | 6/1895 | United Kingdom | 160/265 |

*Primary Examiner*—Blair M. Johnson
*Attorney, Agent, or Firm*—Lane, Aitken & McCann

[57] ABSTRACT

An operating arrangement for an electrically operated window screening device of the type comprising a flexible screening body (1) which is rolled up on a roller (2) positioned in or at an upper horizontal main frame or sash member of the window and in a free end is connected with a bottom rail (4) extending the width of the window. The operating arrangement comprises a cord or string-formed pull-element (12, 13; 24) acting on the screening body and being wound on a winding device (11; 22, 23) positioned at a lower main frame or sash member, with an accompanying electrical drive motor (9). For moving the screening body (1) in an unrolling direction, the pull-element (12, 13; 24) is guided from the winding device along both opposite main frame or sash side sections of the window for connection with the bottom rail (4), whereas the movement of the screening body in the opposite rolling up direction is effected by a spring force acting on said roller (2) during simultaneous unwinding of the pull-element from the winding device. The pull-element (12, 13; 24) may be connected with a separate bar profile (5) designed for after-mounting on a bottom rail (4) for a screening device already installed.

7 Claims, 2 Drawing Sheets

OPERATING ARRANGEMENT FOR AN ELECTRICALLY OPERATED WINDOW SCREENING DEVICE

Figure 1:
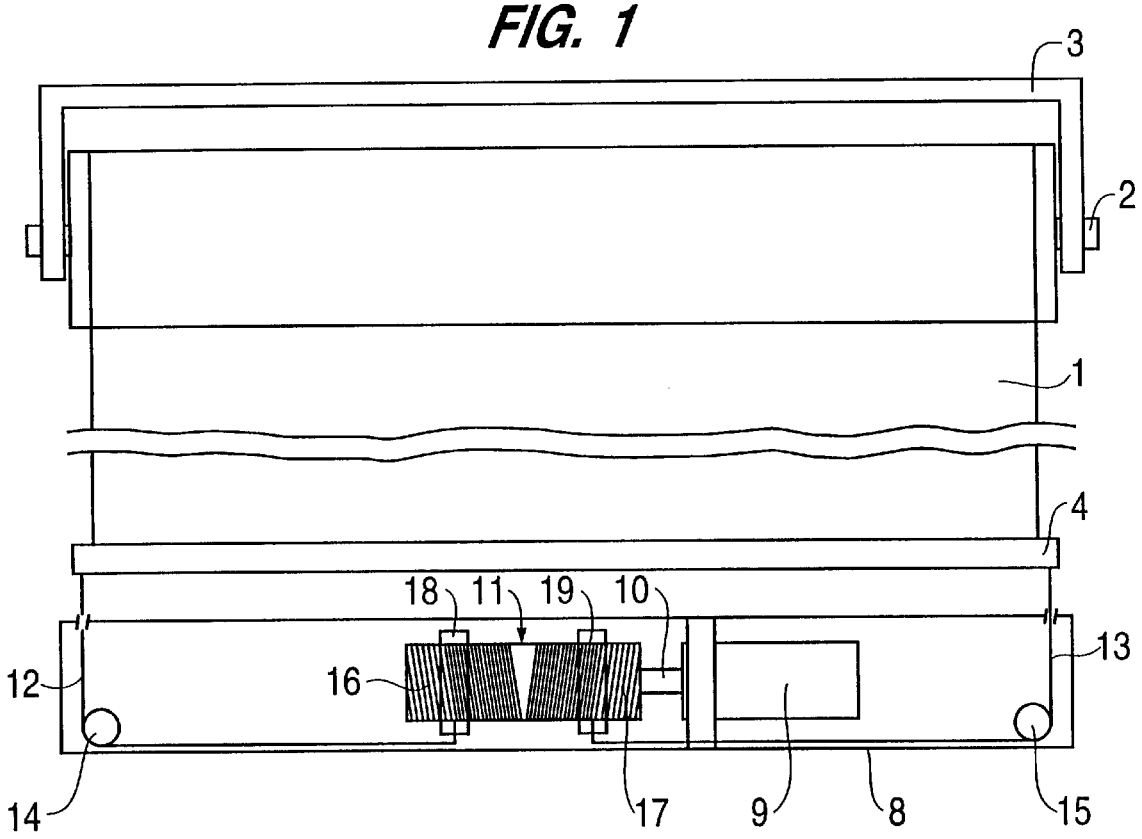

The invention concerns an operating arrangement for an electrically operated window screening device of the type comprising a screening body which in a non-active position (unscreened window) is rolled up on a roller or is folded in or at an upper horizontal main frame or sash member for the window and in a free end is connected with a bottom rail extending in the width of the window, which operating arrangement, for moving the screening body in one direction, comprises a cord or string-formed pull-element acting on the screening body and being wound on a winding device positioned at a lower main frame or sash member and with an accompanying electrical drive motor.

Such a device is known in the form of a roller shutter from the German patent No. 32 14 235. The rolling out of the roller shutter discussed in this patent is effected by means of the gravitational force and the rolling up is made by the electrical drive motor causing a winding of the pull-element on the winding device.

This known operating arrangement is thus used only in restricted areas since it is not suitable for other forms of screening devices such as roller blinds where it is the unrolling movement which is driven by motor, or tilted screening devices where the gravitation component in the unrolling direction is small as it is e.g. the case with roof windows. Besides, this operating device requires a special design of the roller in the upper main frame or sash member and of the cord routing.

Therefore, the purpose of the invention is to provide an improved and simplified operating device of the initially stated kind such that it may be applied to other types of screening devices.

In order to secure this end, the operating arrangement according to the invention is characterized in that for moving the screening body in a direction of unrolling or unfolding, the pull-element is from the winding device guided along both opposite main frame or sash side members of the window for connection with said bottom rail, whereas the movement of the screening body in the opposite direction of rolling up or folding or folding is in a manner known per se effected by means of a spring force acting in said direction of rolling up or folding during simultaneous dewinding of the pull-element from the winding device.

Thus, a simple and secure operation of the screening device is ensured, and the guidance of the pull-element along the sides of the window entails that the entire visual field remains unaffected.

In an embodiment especially suitable for use in connection with existing screening devices, the pull-element is connected with a separate bar profile designed for after-mounting on a bottom rail for the screening device already installed.

The pull-element may be designed either as two separate draw cords or strings fastened in each end of the bottom rail or the separate bar profile or as a single draw cord guided through the bottom rail or the separate bar profile in their entire length.

In a preferred embodiment, the winding device comprises, as it is known per se from SE patent No. 222 909, two drum parts for each end of said one draw cord or for each of said draw cords or strings, and the drum parts are preferably designed as threaded portions with opposite lead directions on a common drum surface and each in engagement with its nut member acting as a control member for the winding of a draw cord in the bottom of the threads on each drum part. There is thus obtained a structure in which the driving shaft is non-displaceable in the axial direction, no particular demands being made, among other, on the bearing of the shaft, and at the same time, the winding of the draw cord in the bottom of the threads prevents that the screening device is pulled up askew.

As a special advantage, there may in connection with the drive motor be provided an end stop device functioning during movement of the screening body in the unrolling direction and/or the rolling up or pulling direction, said device is active both when the screening device strikes its end positions and when it meets an obstacle on its way.

Figure 2:
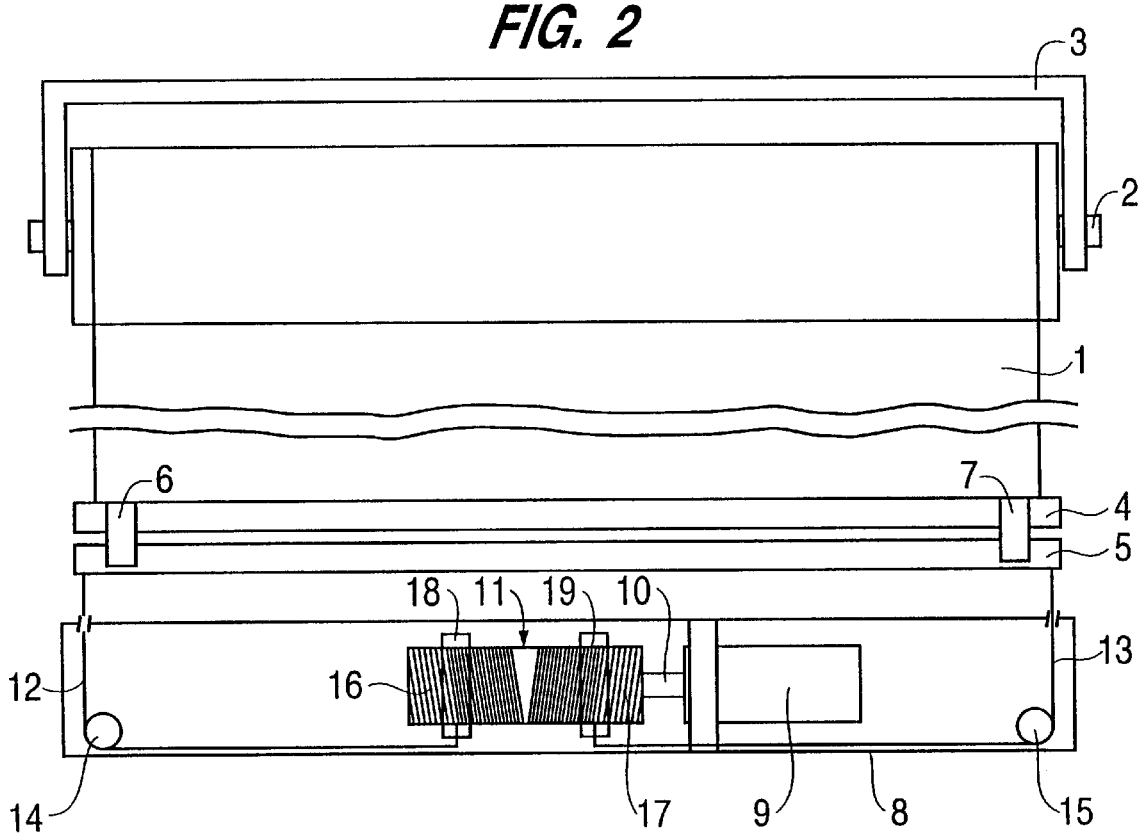
Figure 3:
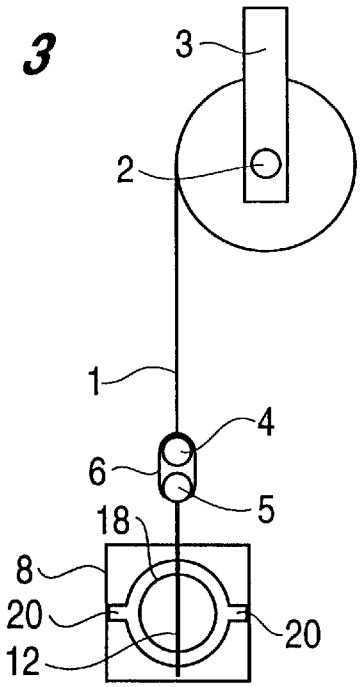
Figure 4:
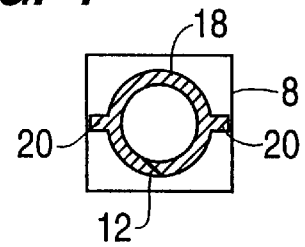
Figure 5:
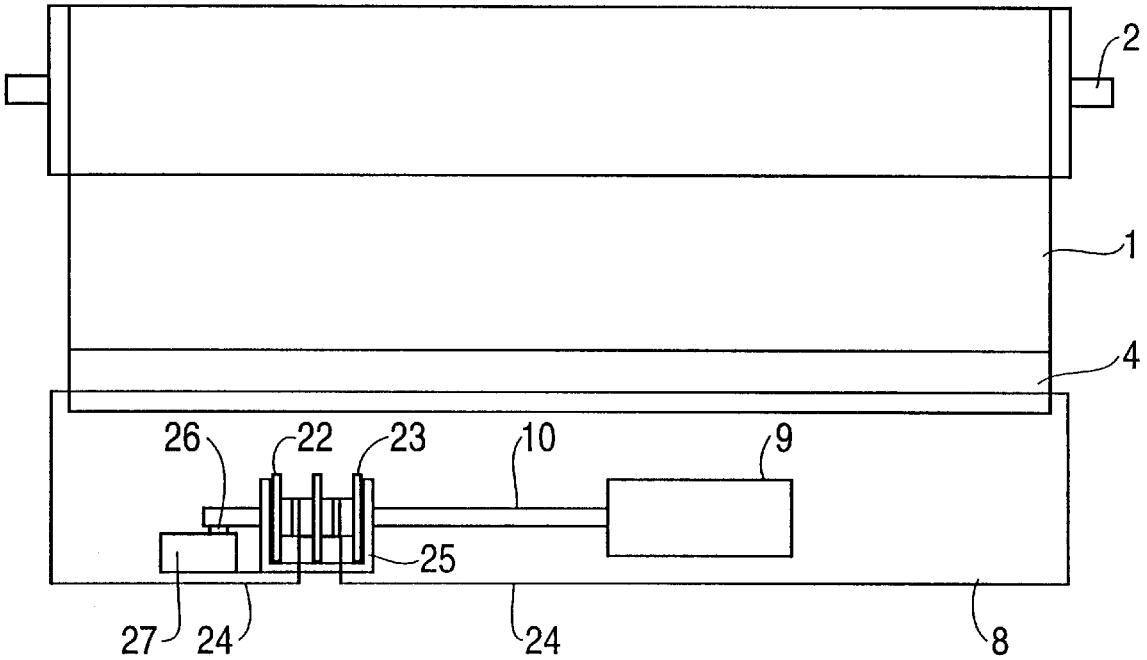

The invention will in the following be explained in detail with reference to the schematic drawing, in which FIG. 1 shows a front view, partially sectional, of an embodiment of an operating arrangement according to the invention, FIG. 2 shows a view corresponding to FIG. 1 and illustrating an embodiment for the invention, FIG. 3 shows a side view of the operating arrangement shown in FIG. 2, FIG. 4 shows a sectional view of a detail of the operating arrangement according to the invention, and FIG. 5 shows another embodiment for the operating arrangement.

Corresponding or like parts will in the different figures be designated by the same referential number.

In FIGS. 1 and 2, there is shown an embodiment for a window screening device in the form of a roller blind with a flexible screening body 1 constituted by the cloth of the roller blind. The screening body 1 is here rolled up on a roller 2 which is mounted with a holder 3 at an upper top member of the sash or the main frame for the non-shown window. The screening device may, however, also be designed as e.g. a pleated blind of the kind disclosed in EP-B1- 0 015 043, which is folded in the non-active position.

At its lower end, the screening body 1 is connected with a bottom rail 4 extending in the entire width of the window. In the embodiment shown in FIG. 2, the bottom rail 4 is connected with a separate bar profile 5 by means of clips 6, 7 as it is also seen in FIG. 3.

The operation of the screening device is effected by means of an operating arrangement positioned in a box 8 at a lower main frame or sash member together with a pull-element. The operating arrangement comprises an electrical drive motor 9 with a gear unit (not shown in detail) and is via a motor shaft 10 connected with a winding device here designed as a drum 11. The pull-element may as shown be designed as two draw cords 12, 13 which are with one end connected with the bottom rail 4 or the separate bar profile 5 and with the other end via guide rolls 14, 15 conducted to and wound around the drum 11. The drum is designed with threaded portions 16, 17 having mutually opposite lead directions and being in engagement with a nut element 18, 19 with corresponding thread. Each nut element 18, 19 is, as appears from FIG. 3, designed with a projection 20 in engagement with corresponding guide tracks (not shown in detail) on or in the side walls of the box 8 such that the nut elements 18, 19 are axially displaceable in relation to the drum 11 and have, as appears from FIG. 4, in its underside a bore for leading the draw cord 12, 13 through.

When unrolling the roller blind, the motor 9 drives the drum 11 via the motor shaft 10, and the nut elements 18, 19 move away from each other during simultaneous winding of the draw cords 12, 13 placing themselves in the threadings in each drum portion 16, 17, whereby the bottom rail 4 and perhaps the bar profile 5 are pulled downwards.

When the screening body 1 is in its fully rolled out position, i.e. where the bottom rail 4 or the bar profile 5 has come to a stop on the lower main frame or sash member, the motor is stopped e.g. by detection and interruption of the motor power when this exceeds a predetermined value or by means of an end stop device as shown in FIG. 5.

In the embodiment shown in this figure, the unrolling is in principle carried out in the same way as in the embodiments described in connection with FIGS. 1–4. However, the winding device is here designed as two rolling up drums 22, 23 for draw cords which in this shown embodiment form one cord 24 lead through the bottom rail 4. The drums 22, 23 is over the motor shaft 10 connected with the drive motor 9. The drums and the motor shaft are embedded in a common bearing bracket 25 with non-shown slots parallel to the direction of the cord force for the motor shaft 10. When, during lowering of the screening device, the bottom rail 4 comes to a stop against the lower main frame or sash member or meets some obstacle, the cord is tightened, such that its load of the motor shaft is reduced or ceased, whereby the motor shaft 10 is made to perform a limited tilting movement by a spring-biassed contact member 26 in an end stop contact 27 or a perhaps adjustable spring positioned under the shaft and the power to the motor is discontinued.

I claim:

1. An operating arrangement for an electrically operated window screening device of the type comprising a screening body (1) which in a non-active position (unscreened window) assumes a position at one of an upper horizontal main frame member and an upper horizontal sash member of the window and which has a free end connected with a bottom rail (4) extending in the width of the window, which operating arrangement, for moving the screening body in one direction, comprises a cord or string-formed pull-element (12, 13; 24) for acting on the screening body, the pull-element being wound on a winding device (11; 22, 23) adapted to be positioned at one of a lower main frame member and a lower sash member, the operating arrangement further comprising an electrical drive motor (9) connected to the winding device, characterized in that, for moving the screening body (1) in a first direction towards an active screening position, the pull-element (13, 14; 24) is guided from the winding device along one of main frame side members and sash side members of the window for connection with said bottom rail (4), whereas the movement of the screening body in a second, opposite direction towards said non-active position is effected by means of a spring force during simultaneous dewinding of the pull-element from the winding device, the operating arrangement including a bar profile (5) entirely external to and separate from said bottom rail (4), the cord or string-formed pull element (12, 13, 24) being connected with the separate bar profile (5), and the separate bar profile being releasably connectable with said bottom rail (4) on a side thereof opposite said free end to permit aftermounting of the operating arrangement for a screening drive already installed.

2. An operating arrangement according to claim 1, characterized in that the pull-element comprises one draw cord (24) guided through the entire length of said separate bar profile (5).

3. An operating arrangement according to claim 1, characterized in that the pull-element comprises two separate draw cords or strings (12, 13) each in connection with an end of said separate bar profile (5).

4. An operating arrangement according to claim 2, characterized in that the winding device (11) comprises first and second drum parts (16, 17) connected with opposite ends of said draw cord, respectively.

5. An operating arrangement according to claim 3, characterized in that the winding device (11) comprises first and second drive parts connected respectively with one and the other of said draw cords or strings.

6. An operating arrangement according to claim 5, characterized in that said drum parts (16, 17) are designed as threaded portions with opposite lead directions on a common drum surface and each in engagement with a nut member acting as a guide element for the winding of a draw cord in the bottom of the threads on each drum part.

7. An operating arrangement according to claim 1, characterized in that in connection with the drive motor (9), there is positioned an end stop device functioning during movement of the screening device in said first direction and/or said second direction.

* * * * *

UNITED STATES PATENT AND TRADEMARK OFFICE

CERTIFICATE OF CORRECTION

PATENT NO. : 5,915,447

DATED : June 29, 1999

INVENTOR(S) : Gert Godvig Lassen

It is certified that error appears in the above-indentified patent and that said Letters Patent is hereby corrected as shown below:

Column 3, line 13, "this" should read "the".

Signed and Sealed this

Fourth Day of April, 2000

*Attest:*

*Attesting Officer*

Q. TODD DICKINSON

*Director of Patents and Trademarks*